US005897674A

United States Patent [19]

Jung et al.

[11] Patent Number: 5,897,674

[45] Date of Patent: Apr. 27, 1999

[54] METHOD FOR MANUFACTURING COAL AGGLOMERATES FOR USE IN DIRECT IRON SMELTING REDUCING FURNACE

[75] Inventors: Young Chae Jung; Dal Hoi Lee; Min Young Cho, all of Pohang, Rep. of Korea

[73] Assignees: Pohang Iron & Steel Co., Ltd.; Research Institute of Industrial Science & Technology, both of Rep. of Korea; Voest-Alpine Industrieanlagenbau, Australia

[21] Appl. No.: 08/894,681

[22] PCT Filed: Dec. 27, 1996

[86] PCT No.: PCT/KR96/00251

§ 371 Date: Aug. 28, 1997

§ 102(e) Date: Aug. 28, 1997

[87] PCT Pub. No.: WO97/24414

PCT Pub. Date: Jul. 10, 1997

[30] Foreign Application Priority Data

Dec. 29, 1995 [KR] Rep. of Korea ..... 95-65206

[51] Int. Cl.[6] ..... C10L 5/00

[52] U.S. Cl. ..... 44/620; 44/626; 75/751; 75/760; 75/770; 75/771

[58] Field of Search ..... 44/620, 626; 75/751, 75/760, 770, 771

[56] References Cited

U.S. PATENT DOCUMENTS

| | | | |
|---|---|---|---|
| 1,810,070 | 6/1931 | Bunce | 75/760 |
| 3,869,350 | 3/1975 | Goossens et al. | 201/32 |
| 4,234,320 | 11/1980 | Verschuur | 75/771 |
| 4,770,766 | 9/1988 | Keller, Jr. et al. | 44/620 |
| 4,830,637 | 5/1989 | Wasson | 44/620 |

*Primary Examiner*—Jacqueline V. Howard
*Attorney, Agent, or Firm*—Webb Ziesenheim Bruening Logsdon Orkin & Hanson, P.C.

[57] ABSTRACT

A method for manufacturing coal agglomerates for use in a direct smelting reducing furnace is disclosed, in which a fine coal is agglomerated at a high temperature in a simple manner, or anthracite or low free swelling coal having a low free swelling index is mixed with the fine coal, and the mixture is agglomerated at a high temperature, thereby turning the low quality coal to useful purpose. The present invention is characterized in that a fine coal having a free swelling index of 3.0 or more and a particle size of 8 mm or less, or the fine coal mixed with 70 weight % of anthracite or a low free swelling coal, is maintained at 600° C. or over for 5 minutes or more, thereby manufacturing coal agglomerates for use in a direct smelting reducing furnace.

8 Claims, 2 Drawing Sheets

METHOD FOR MANUFACTURING COAL AGGLOMERATES FOR USE IN DIRECT IRON SMELTING REDUCING FURNACE

This application is a 371 of PCT/KR96/50251

FIELD OF THE INVENTION

The present invention relates to a method for manufacturing coal agglomerates for use in a direct iron smelting reducing furnace. More specifically, the present invention relates to a method for manufacturing coal agglomerates, in which fine coal is agglomerated at a high temperature.

DESCRIPTION OF THE PRIOR ART

The coal which is used in a direct smelting reducing furnace as an energy source has to have a uniform particle size (8–35 mm).

However, 50% or more of the coal which is supplied for use in the direct smelting reducing furnace is fine coal having a particle size of 8 mm or less. This fine coal is flown into the generator gas line when it is put into the smelting furnace, and therefore, the fine coal becomes useless.

That is, the supplied ordinary coal is subjected to a particle size classification, and the agglomerates having a size of 8 mm or more are put into the smelting reducing furnace after dewatering them. However, the fine coal having a particle size of 8 mm or less cannot be used.

Therefore, if the fine coal having a particle size of 8 mm or less is to be used in the smelting reducing process, it has to be first agglomerated.

A method of agglomerating the fine coal is disclosed in U.S. Pat. No. 3,869,350 which relates to a method for heat-treating a coking coal. In this method, the fine coal is injected into a tube in which a high temperature gas flows, thereby agglomerating the fine coal.

However, in the above described agglomerating method, there is the disadvantage that a high temperature gas supply device is required, the temperature rising rate having to be 100° C./sec.

SUMMARY OF THE INVENTION

In order to solve the above described problem, the present inventor carried out research and experiments, and based on the result of the research and experiments, the present invention is proposed.

Therefore it is an object of the present invention to provide a method for manufacturing coal agglomerates for use in a direct smelting reducing furnace, in which the self agglomerating trend of coal owing to its self sticking property during a thermal decomposition process is utilized, so that the fine coal can be agglomerated at a high temperature in a simple manner.

It is another object of the present invention to provide a method for manufacturing coal agglomerates for use in a direct smelting reducing furnace, in which anthracite or low free swelling coal having a low free swelling index is mixed with the fine coal, and the mixture is agglomerated at a high temperature, thereby turning the low quality coal to useful purpose.

In achieving the above objects, the method for manufacturing coal agglomerates for use in a direct smelting reducing furnace according to the present invention is characterized in that a fine coal having a free swelling index of 3.0 or more and a particle size of 8 mm or less is maintained at 600° C. or over for 5 minutes or more, thereby manufacturing coal agglomerates for use in a direct smelting reducing furnace.

In another aspect of the present invention, the method for manufacturing coal agglomerates for use in a direct smelting reducing furnace according to the present invention is characterized in that a fine coal having a free swelling index of 3.0 or more and a particle size of 8 mm or less is mixed with 70 weight % of anthracite or allow free swelling coal, and is maintained at 600° C. or over for 5 minutes or more, thereby manufacturing coal agglomerates for use in a direct smelting reducing furnace.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
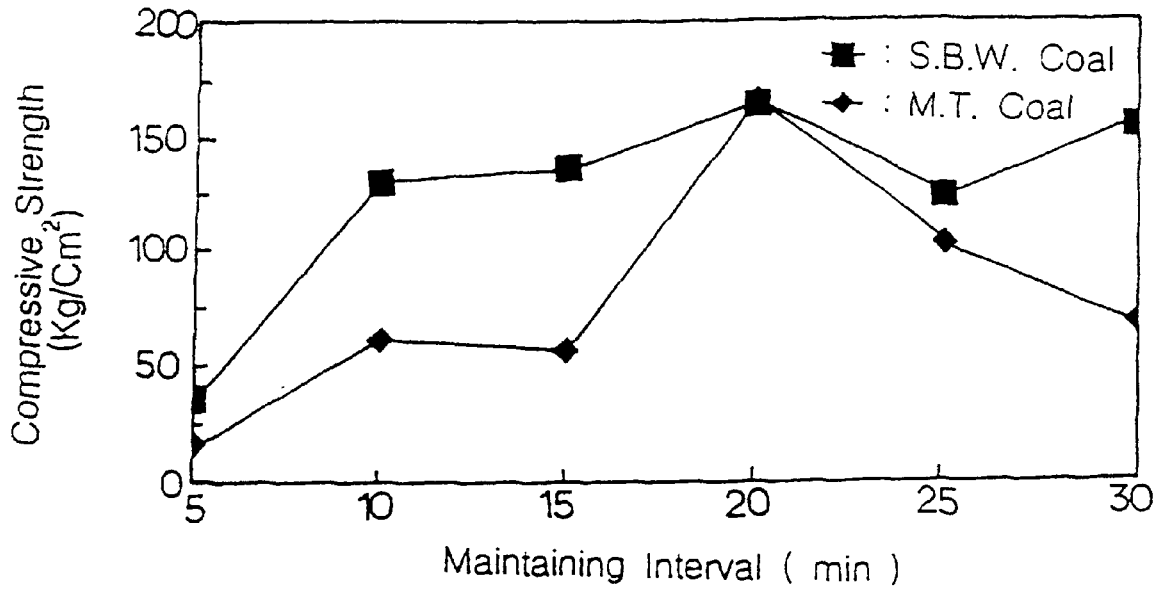
FIG. 1 is a graphical illustration showing the variation of the compressive strength versus the maintaining time during the agglomeration of the fine coal.

The coal which is preferably used in agglomerating the fine coal according to the present invention is ordinary coal having a particle size of 8 mm or less, and a free swelling index of 3.0 or more.

The above defined ordinary coal is obtained from a direct smelting reducing process.

If the coal agglomerates for use in a direct iron smelting reducing furnace are to be manufactured according to the present invention, the fine coal has to be maintained at 600° C. for 5 minutes or more. The reason is as follows. If the maintaining temperature (agglomerating temperature) is below 600° C., the coal agglomerates are easily broken, and the compressive strength required in the direct smelting reducing furnace cannot be obtained.

The higher the agglomerating temperature is, the more the compressive strength is increased. Particularly, a superior compressive strength is obtained at a temperature of 650–800° C.

Therefore, if a superior compressive strength is to be obtained, a maintaining temperature of 650–800° C. should be preferably applied.

Further, during the agglomeration of the fine coal, the maintaining time (agglomerating time) has to be 5 minutes or more, and the reason is as follows. If it is maintained for less than 5 minutes, the compressive strength is lowered.

Meanwhile, the coal agglomerates can also be manufactured in such a manner that the fine coal is mixed with a low free swelling coal having a low sticking property or with anthracite having no sticking property, and the mixture is maintained at 600° C. or over for 5 minutes or more.

The mixing proportion of the low free swelling coal or the anthracite has to be 70 weight %, and the reason is as follows. If the proportion is more than 70%, the compressive strength which is suitable for the direct smelting reducing furnace cannot be obtained.

Thus the fine coal is agglomerated according to the present invention, thereby producing coal agglomerates having a particle size of 8 mm or more.

Here the coal agglomerates refer to that which is obtained from the fine coal through agglomeration.

In the present invention, a waste heat generated from the smelting reducing furnace is used as the heat source. The fine coal is preferably obtained from the direct iron smelting reducing process, and the manufactured coal agglomerates are for use in the direct smelting reducing furnace.

Generally, the reducing gas which is generated from a smelting reducing furnace has a temperature of about 1100° C. The optimum temperature which is required by an upper shaft furnace is about 850° C. Therefore, prior to entering into the shaft furnace, about 20% of the reducing gas of about 850° C. is cooled down to about 50° C. during the passage through a ventury scrubber. This recycled cooled gas is flown into the generator gas line, so as to be used as a temperature control means for the reducing gas.

Therefore, the high temperature fine coal agglomerating facility is installed upstream of the ventury scrubber. Thus, by utilizing the waste heat of the high temperature (about 850° C.) reducing gas, the fine coal is agglomerated according to the present invention.

Further, the high temperature coal agglomerates which are obtained in the above described method can be put into the top of the direct iron ore smelting reducing furnace.

Thus the coal agglomerates for use in the direct smelting reducing furnace are manufactured by utilizing the waste heat generated in the smelting reducing furnace as the heat source, and by utilizing the fine coal obtained from the direct iron ore smelting reducing furnace. In this case, there are the following advantages.

That is, the fine coal of less than 8 mm obtained from the direct smelting reducing furnace can be turned to a useful purpose. The fine coal can be agglomerated by mixing it with the low free swelling coal or with anthracite. Further, not only the waste heat of the reducing gas can be utilized to a useful purpose, but also the coal agglomerates which are heated to a high temperature (about 600° C. or over) can be directly put into the top of the direct iron ore smelting reducing furnace. Therefore, the temperature raising heat which is required in the case of using a normal temperature coal can be saved.

Now the present invention will be described based on actual examples.

Example 1

Two kinds of fine coals [S. B. W. (south black water) coal and M.T. (mountain thorey) coal] which were obtained from a direct iron ore smelting reducing process and which had a free swelling index of 4.5 and a particle size of 8 mm were put into crucibles. Then these crucibles were put into an electric furnace which had been heated to a temperature of 850° C. Then their compressive strengths were measured at every maintaining interval of 5 minutes up to 30 minutes. The measured results are shown in FIG. 1. As shown in FIG. 1, if the maintaining interval is more than 5 minutes, a sufficient compressive strength can be obtained. That is, there was obtained a compressive strength of more than 5Kg/cm$^2$ which is the minimum compressive strength usable in the direct iron ore smelting reducing process.

Example 2

The M.T. coal of Example 1 was used with a maintaining interval of 10 minutes, and by varying the maintaining temperature (reaction temperature) by 50° C. up to 600–850° C., thereby agglomerating the coal. Then the compressive strength was measured at the end of every temperature interval of 50° C., and the measured results are shown in FIG. 2.

Figure 2:
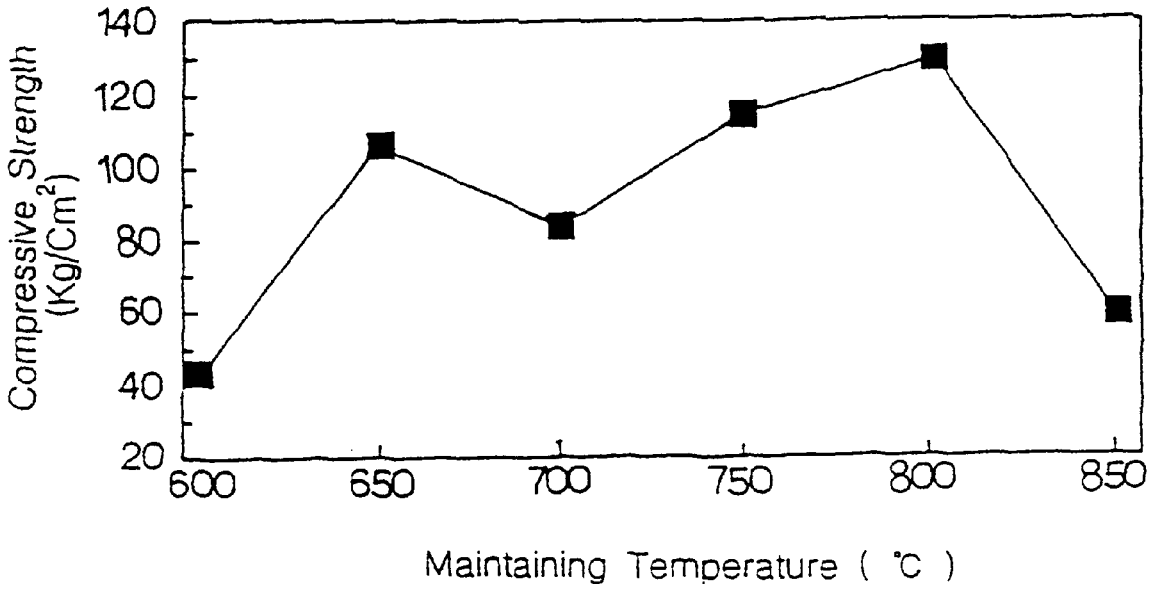
FIG. 2 is a graphical illustration showing the variation of the compressive strength versus the maintaining temperature during the agglomeration of the fine coal.

As shown in FIG. 2., when the maintaining temperature was 600° C., a sufficient compressive strength could be obtained.

Example 3

The M.T. coal of Example 1 was heated in such a manner that the reaction temperature was fixed to 850° C., and the reaction interval was fixed to 10 minutes. Further, anthracite was mixed increasingly by 10% starting from 20% to 70%, thereby agglomerating the mixture coal. Thus the compressive strength was measured at every 10% increase of anthracite, and the measured results are shown in FIG. 3.

Figure 3:
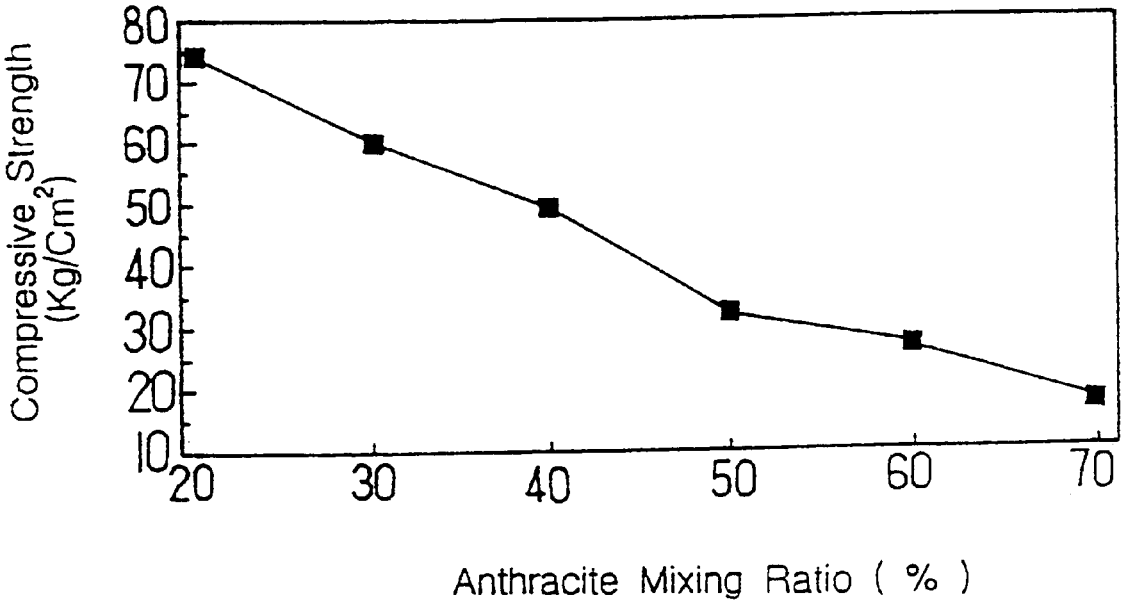
FIG. 3 is a graphical illustration showing the variation of the compressive strength versus the mixing ratio between the anthracite and the fine coal.

As shown in FIG. 3, as the mixing amount of anthracite was increased, so much the compressive strength was decreased, but up to 70%, the compressive strength was sufficient for use in the iron ore smelting reducing process.

According to the present invention as described above, the fine coal which is obtained from the direct iron ore smelting reducing process can be agglomerated in a simple manner. Further, the anthracite having no sticking property or low free swelling coal can be mixed with the fine coal, and therefore, the energy utilization is done in an advantageous manner. Particularly, in the case where a fine coal of 8 mm or less obtained from the direct smelting reducing process is agglomerated based on the present invention, the anthracite or the low free swelling coal having a low free swelling index can be utilized, thereby making it possible to use even low quality coals. Further, the coal which is heated to a high temperature is put into the top of the direct iron ore smelting reducing furnace, and therefore, the dome shaped portion is naturally heated, with the result that the energy can be saved.

What is claimed is:

1. A method for manufacturing coal agglomerates for use in a direct iron ore smelting reducing furnace by using a fine coal, comprising the steps of:

providing a fine coal having a free swelling index of 3.0 or more and a particle size of 8 mm or less, and agglomerating said fine coal by heating to a temperature of at least 600° C. for at least 5 minutes.

2. The method as claimed in claim 1, wherein said fine coal is agglomerated at a temperature of 650–850° C.

3. The method as claimed in claim 1, wherein said fine coal is obtained from a direct iron ore smelting reducing process.

4. A method for manufacturing coal agglomerates for use in a direct iron ore smelting reducing furnace by using a fine coal, comprising the steps of:

providing a fine coal having a free swelling index of 3.0 or more and a particle size of 8 mm or less, mixing said fine coal with one of a low free swelling coal or anthracite coal in an amount of no greater than 70 weight %, and agglomerating said fine coal mixture by heating to a temperature of at least 600° C. for at least 5 minutes.

5. The method as claimed in claim 4, wherein said fine coal is agglomerated at a temperature of 650–850° C.

6. The method as claimed in claim 4, wherein said fine coal is obtained from a direct iron ore smelting reducing process.

7. The method as claimed in claim 2, wherein said fine coal is obtained from a direct iron ore smelting reducing process.

8. The method as claimed in claim 5, wherein said fine coal is obtained from a direct iron ore smelting reducing process.

* * * * *

UNITED STATES PATENT AND TRADEMARK OFFICE

CERTIFICATE OF CORRECTION

PATENT NO. : 5,897,674

DATED : April 27, 1999

INVENTOR(S) : Young Chae Jung et al.

It is certified that error appears in the above-identified patent and that said Letters Patent is hereby corrected as shown below:

Title Page, [73] Assignees, "Australia" should read --Austria--.

Column 2 Line 6 "allow" should read --a low--.

Signed and Sealed this

Sixteenth Day of November, 1999

*Attest:*

*Attesting Officer*

Q. TODD DICKINSON

*Acting Commissioner of Patents and Trademarks*